US009868189B2

(12) United States Patent
Lin

(10) Patent No.: US 9,868,189 B2
(45) Date of Patent: Jan. 16, 2018

(54) RATCHET WRENCH WITH RESTRICTION MEMBER FOR RESTRICTING MOVEMENT OF PAWL

(71) Applicant: Li-Ching Lin, Taichung (TW)

(72) Inventor: Li-Ching Lin, Taichung (TW)

( * ) Notice: Subject to any disclaimer, the term of this patent is extended or adjusted under 35 U.S.C. 154(b) by 284 days.

(21) Appl. No.: 14/929,345

(22) Filed: Nov. 1, 2015

(65) Prior Publication Data

US 2017/0120425 A1 May 4, 2017

(51) Int. Cl.
*B25B 13/46* (2006.01)

(52) U.S. Cl.
CPC ..... *B25B 13/463* (2013.01)

(58) Field of Classification Search
CPC ..... B25B 13/463
See application file for complete search history.

(56) References Cited

U.S. PATENT DOCUMENTS 5,636,557 A * 6/1997 Ma ..... B25B 13/463 81/60
5,979,274 A * 11/1999 Hsieh ..... B25B 13/462 81/125.1
6,748,825 B2 * 6/2004 Hsu ..... B25B 13/463 192/41 R
6,807,882 B2 * 10/2004 Hu ..... B25B 13/463 81/58
6,854,362 B1 * 2/2005 Huang ..... B25B 13/463 81/60
6,862,955 B1 * 3/2005 Shu-Sui ..... B25B 13/463 192/41 R
6,874,391 B2 * 4/2005 Hsien ..... B25B 13/463 81/60
7,044,029 B1 * 5/2006 Hopper, Jr. ..... B25B 13/463 81/60
7,100,477 B2 * 9/2006 Lee ..... B25B 13/463 81/58
8,051,747 B1 * 11/2011 Tsai ..... B25B 13/463 81/52
8,104,381 B1 * 1/2012 Chen ..... B25B 13/463 81/63.2
RE43,286 E * 4/2012 Hu ..... B25B 13/463 81/60
8,261,635 B2 * 9/2012 Lee ..... B25B 13/463 81/60
8,291,792 B2 * 10/2012 Yang ..... B25B 13/463 81/60
2005/0044996 A1 * 3/2005 Huang ..... B25B 13/463 81/60

(Continued)

*Primary Examiner* — David B Thomas

(57) ABSTRACT

A ratchet wrench includes a head with a first room in which a ratchet wheel is rotatably received. A second room is defined in the inner periphery of the first room and a pawl is received in the second room. The pawl is biased by a resilient member in a recess defined in the inner periphery of the second room. A restriction member is located in the second room and has a first contact portion for contacting one end of the pawl, a second contact portion for contacting the engaging teeth of the pawl, and a contact corner for contacting the inside of the second recess. A gap between the first contact portion and the end of the pawl is 0 to 1 mm. The restriction member restricts the movement of the pawl in the second room.

10 Claims, 12 Drawing Sheets

(56) References Cited

U.S. PATENT DOCUMENTS

| | | | | |
|---|---|---|---|---|
| 2011/0100165 | A1* | 5/2011 | Lee | B25B 13/463 81/60 |
| 2012/0000323 | A1* | 1/2012 | Yang | B25B 13/463 81/61 |
| 2012/0186402 | A1* | 7/2012 | Yang | B25B 13/463 81/60 |
| 2012/0222523 | A1* | 9/2012 | Feng | B25B 13/463 81/60 |
| 2013/0032008 | A1* | 2/2013 | Lee | B25B 13/463 81/60 |

* cited by examiner

A-A

A-A

C-C

C-C

RATCHET WRENCH WITH RESTRICTION MEMBER FOR RESTRICTING MOVEMENT OF PAWL

BACKGROUND OF THE INVENTION

1. Fields of the Invention

The present invention relates to a ratchet wrench, and more particularly, to a ratchet wrench having a restriction member in the same room with the pawl which is restricted by the restriction member to ensure that the pawl is moved under control.

2. Descriptions of Related Art

The conventional ratchet wrench as disclosed in FIG. 13 and comprises a head 91, a ratchet wheel 92, a pawl 93, a resilient member 94 and a clip 96. The head 91 has a first room 911 defined therethrough and a flange extends from the lower inner periphery of the first room 911. A second room 912 is defined in the inner periphery of the first room 911. The second room 912 has a closed top and a closed bottom. The first room 911 has a first groove 913, and the second room 912 has a recess 914 defined in the inner periphery thereof. The ratchet wheel 92 is rotatably received in the first room 911 and has an engaging portion 921 on the outer periphery thereof. A mounting portion 922 is defined through the top and the bottom of the ratchet wheel 92. The ratchet wheel 92 has a second groove 923 which is located corresponding to the first groove 913. The pawl 93 is received in the second room 912 and has multiple engaging teeth 931 on the front thereof. The resilient member 94 is located in the recess 914 and biased between the inner end of the recess 914 and the rear side of the pawl 93 so as to engage the engaging teeth 931 with the engaging portion 921 of the ratchet wheel 92. The clip 96 is engaged with the first and second grooves 913, 923.

However, as disclosed in FIGS. 14 to 16, when the head 10 is rotated counter clockwise to push the pawl 92 away from the pawl 93, because the volume of the pawl 93 is about 3/10 of the volume of the second room 912, there is a space available for the pawl 92 to move within the second room 912. Therefore, the pawl 93 is driven by the rotation of the ratchet wheel 92 and moves a distance that is more than needed, this causes the head 91 together with the ratchet wheel 92 to rotate freely. Besides, the inclined recess 914 is difficult to be drilled.

U.S. Pat. No. 7,444,901 discloses a ratchet wrench comprising a wrench body having an end portion provided with a mounting hole and a receiving chamber connected to the mounting hole. A ratchet wheel is mounted in the mounting hole of the wrench body and has an outer wall provided with a plurality of ratchet teeth. A pawl member defines a top surface and a bottom surface mounted in the receiving chamber of the wrench body having a first side including a first end provided with a plurality of locking teeth extending from the top surface to the bottom surface engaged with the ratchet teeth of the ratchet wheel successively and completely and a second end provided with a sliding face extending from the top surface to the bottom surface slidable on the ratchet teeth of the ratchet wheel. The first and second ends define a whole circumferential length of the first side of the pawl member. An elastic member is mounted in the receiving chamber of the wrench body and biased between the peripheral wall of the receiving chamber of the wrench body and a second side of the pawl member to push the pawl member toward the ratchet wheel. The elastic member is located adjacent to the sliding face of the pawl member and the sliding face of the pawl member is located between the elastic member and the locking teeth of the pawl member. The first side of the pawl member is a concave surface which extends through the whole circumferential length of the first side of the pawl member. The sliding face of the pawl member is a concave recessed smooth surface which extends successively and completely through a circumferential length of the second end of the first side of the pawl member that is half of the circumferential length of the first side of the pawl member. The pawl member is movable relative to the ratchet wheel between a first position where all of the locking teeth of the pawl member are engaged with the ratchet teeth of the ratchet wheel closely and completely, and the sliding face of the pawl member evades the ratchet teeth of the ratchet wheel, and a second position where all of the locking teeth of the pawl member are disengaged from the ratchet teeth of the ratchet wheel, and the sliding face of the pawl member is movable on the ratchet teeth of the ratchet wheel.

In order to restrict the movement of the pawl member in the receiving chamber, the volume of the pawl member is slightly smaller than the volume of the receiving chamber. In other words, the pawl member has to be made big enough to meet the above mentioned requirement. However, the pawl member is made by way of powder injection, so that the larger volume of the pawl member, the higher cost is involved. Therefore, there is a room to be improved.

The present invention intends to provide a ratchet wrench to eliminate the shortcomings mentioned above.

SUMMARY OF THE INVENTION

The present invention relates to a ratchet wrench and comprises a head having a handle extending therefrom. The head has a first room defined through the top and the bottom thereof. A second room is defined in the inner periphery of the first room. A first groove is defined in the inner periphery of the first room and located close to the top of the head. A recess is defined in the inner periphery of the second room. A ratchet wheel is rotatably received in the first room and has an engaging portion defined in the outer periphery thereof. The engaging portion has ratchet teeth.

A mounting portion is defined axially to the ratchet wheel. A pawl is received in one side of the second room and has a front side and a rear side, wherein multiple engaging teeth are defined in the front side of the pawl and engaged with the ratchet teeth of the engaging portion. The pawl has a first end and a second end, wherein a contact face is formed to the second end of the pawl. The volume of the pawl is ½ to 7/10 of the volume of the second room. A plane passes through the central axis of the first room and the central axis of the recess, and an angle of 20 to 30 degrees is defined between the contact face and the plane. A resilient member is received in the recess and biased between the inner end of the recess and the rear side of the pawl so as to engage the engaging teeth of the pawl with the ratchet teeth of the engaging portion. A restriction member is received in the second room and has a first contact portion, a second contact portion and a contact corner. A gap between the first contact portion and the contact face is 0 to 1 mm. The second contact portion contacts the engaging portion. The contact corner contacts the inside of the second room. A clip is engaged with the first groove to restrict the ratchet wheel in the first room.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
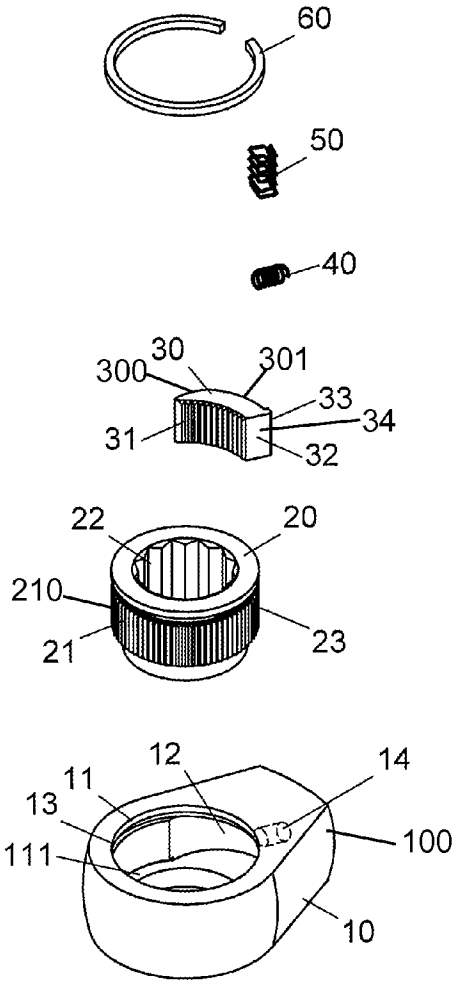
FIG. 1 is an exploded view of the ratchet wrench of the present invention.

Referring to FIGS. 1, 4 to 6, the ratchet wrench of the present invention comprises a head 10 having a handle 100 extending therefrom. The head 10 has a first room 11 defined through the top and the bottom thereof. A flange 111 extends inward from the lower portion of the inner periphery of the first room 11. A second room 12 is defined in the inner periphery of the first room 11. A first groove 13 is defined in the inner periphery of the first room 11 and located close to the top of the head 10. A recess 14 is defined in the inner periphery of the second room 12.

A ratchet wheel 20 is rotatably received in the first room 11 and has an engaging portion 21 defined in the outer periphery thereof. The ratchet wheel 20 is supported by the flange 111. The engaging portion 21 has ratchet teeth 210. A mounting portion 22 is defined axially to the ratchet wheel 20. The mounting portion 22 is a polygonal hole or a polygonal rod. A second groove 23 is defined in the ratchet wheel 20 and located corresponding to the first groove 13.

A pawl 30 is received in one side of the second room 12 and has a front side and a rear side, wherein multiple engaging teeth 31 are defined in the front side of the pawl 30 and engaged with the ratchet teeth 210 of the engaging portion 21. The pawl 30 has a first end and a second end, wherein a flat contact face 32 is formed to the second end of the pawl 30. The volume of the pawl 30 is ½ to 7/10 of the volume of the second room 12. Preferably, the volume of the pawl 30 is ½ to ⅔ of the volume of the second room 12.

Specifically, the pawl 30 has a first curved face 300 and a second curved face 301 defined in a rear side thereof. The first curved face 300 has the radius the same as the radius of the second room 12. The first and second curved faces 300, 301 are located close to the first and second ends of the pawl 30 respectively. A protrusion 33 extend from the second curved face 301. The lateral side of the protrusion 33 is a flat face located on a same plane 34 with the flat contact face 32.

Figure 6:
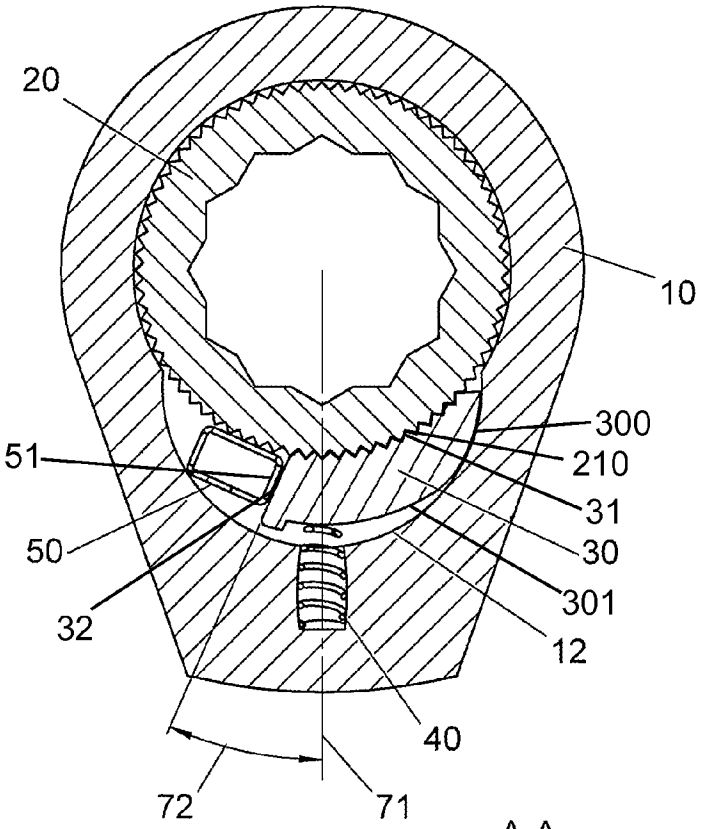
FIG. 6 is a cross sectional view, taken along line A-A of FIG. 5.
Figure 5:
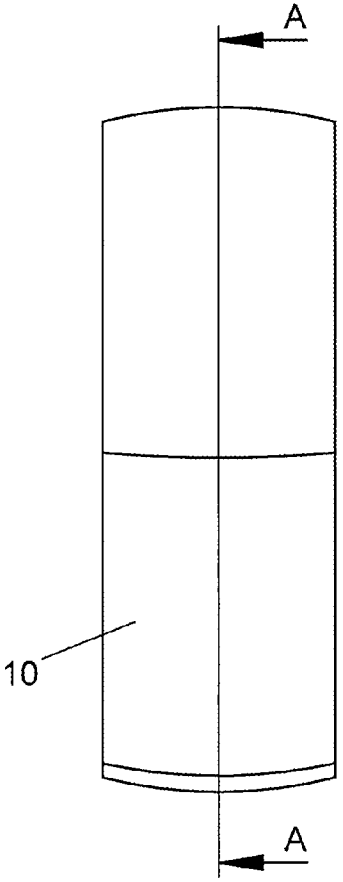
FIG. 5 is a side view to show the ratchet wrench of the present invention.

As shown in FIG. 6, a plane 71 passes through the central axis of the first room 11 and the central axis of the recess 14, and an angle 72 of 20 to 30 degrees is defined between the contact face 32 and the plane 71. Preferably, the angle 72 is 20 to 25 degrees.

A resilient member 40 is received in the recess 14 and biased between the inner end of the recess 14 and the rear side of the pawl 30 so as to engage the engaging teeth 31 of the pawl 30 with the ratchet teeth 210 of the engaging portion 21.

Figure 3:
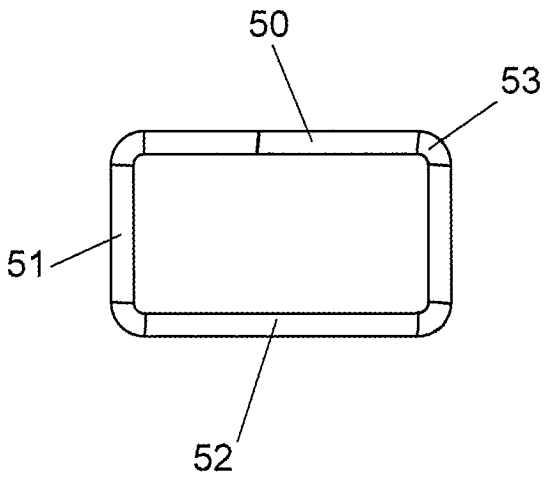
FIG. 3 is a top view to show the restriction member of the ratchet wrench of the present invention.
Figure 2:
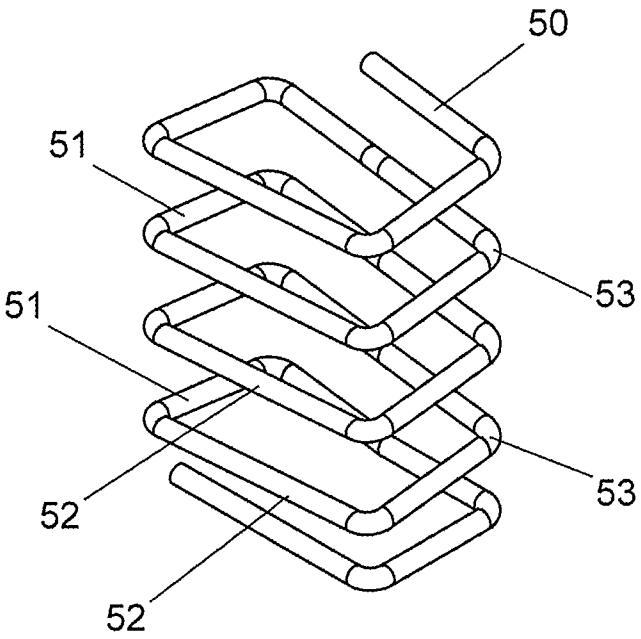
FIG. 2 is a perspective view to show the restriction member of the ratchet wrench of the present invention.
Figure 4:
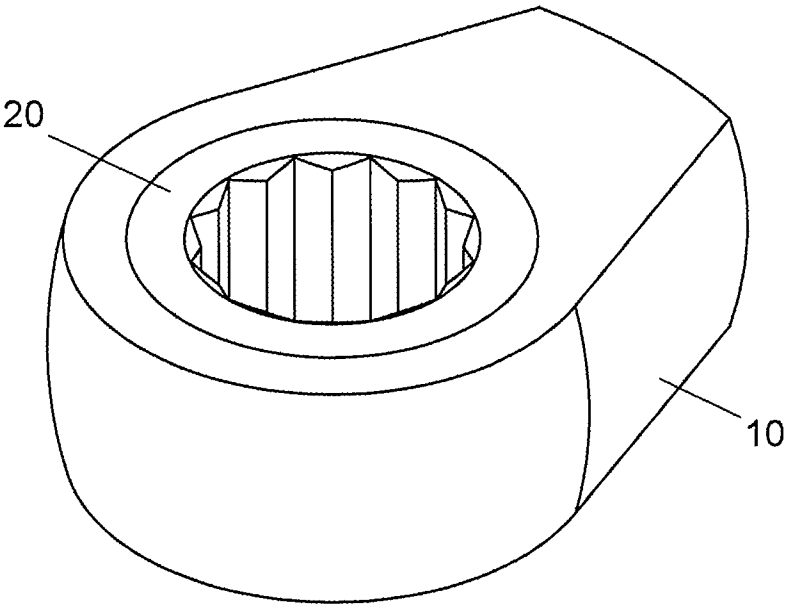
FIG. 4 is a perspective view to show the ratchet wrench of the present invention.
Figure 9:
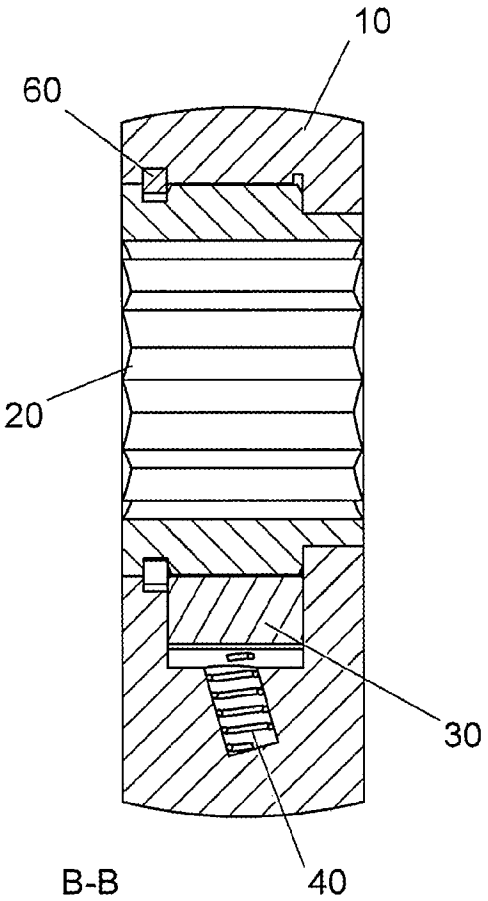
FIG. 9 is a cross sectional view, taken along line B-B of FIG. 8.
Figure 8:
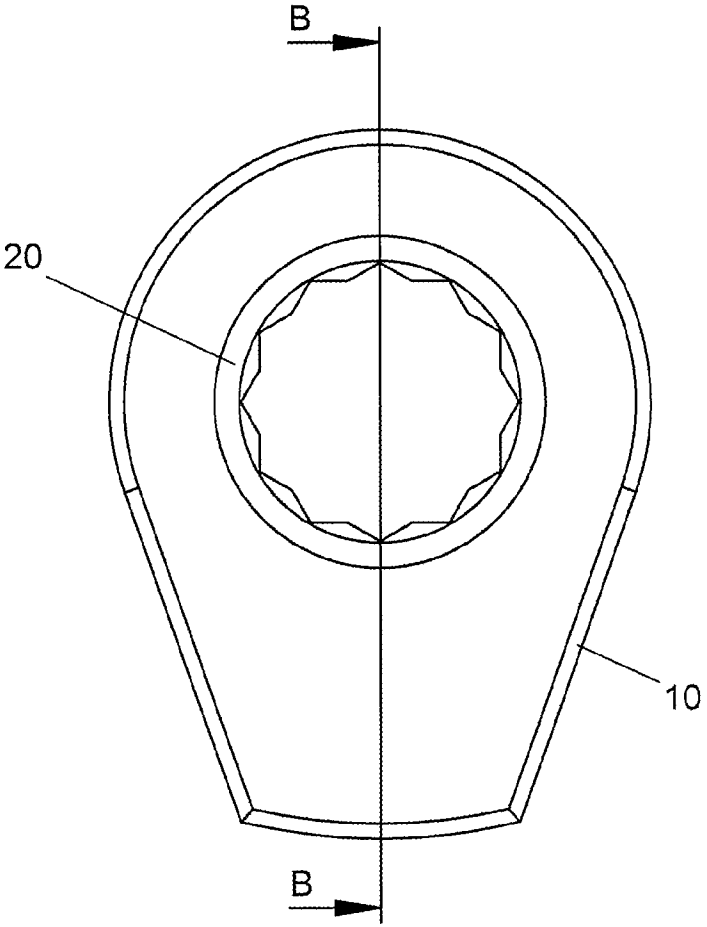
FIG. 8 is a top view of the ratchet wrench of the present invention.

As shown in FIGS. 2 and 3, the restriction member 50 is a rectangular spring which is formed by bending a wire into continuous rectangular sections. The restriction member 50 is received in the second room 12 and has a first contact portion 51, a second contact portion 52 and a contact corner 53. A gap between the first contact portion 51 and the contact face 32 is 0 to 1 mm. The second contact portion 52 contacts the engaging portion 21. The contact corner 53 contacts the inside of the second room 12. As shown in FIGS. 8 and 9, a C-shaped clip 60 is engaged with the first groove 13 and the second groove 23 to restrict the ratchet wheel 20 in the first room 11.

When rotating the head 10 counter clockwise, the engaging teeth 31 of the pawl 30 are engaged with the ratchet teeth 210 of the engaging portion 21 as shown in FIG. 6.

Figure 7:
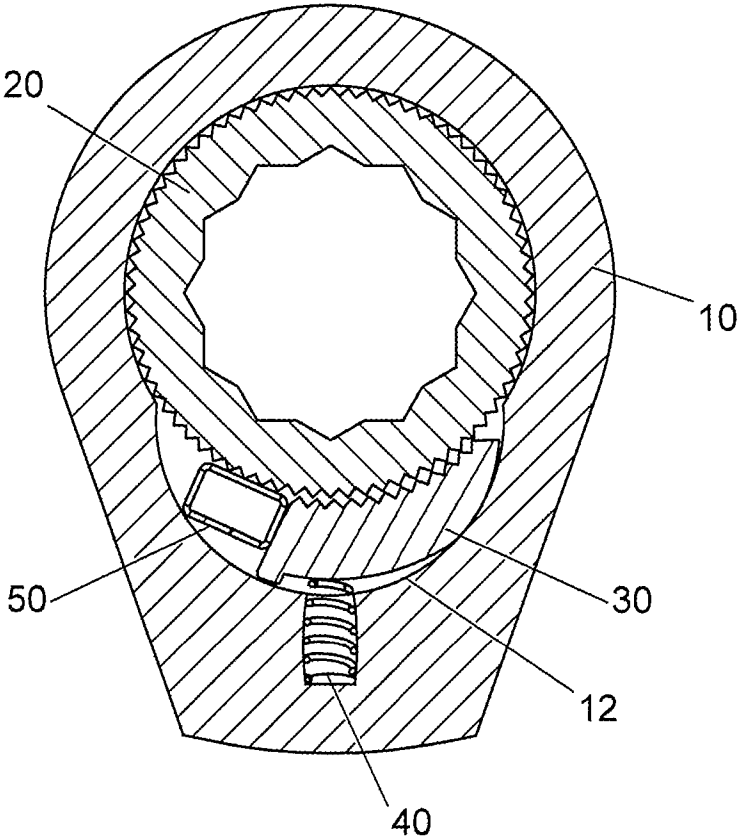
FIG. 7 is a cross sectional view to show that the engaging teeth of the pawl are disengaged from the ratchet teeth of the pawl.

As shown in FIG. 7, when the head 10 is rotated clockwise, the engaging teeth 31 of the pawl 30 are disengaged from the ratchet teeth 210 of the engaging portion 21, and the pawl 30 is moved backward and restricted by the restriction member 50, so that the pawl 30 cannot moved too far, and the ratchet teeth 210 of the engaging portion 21 are moved over the engaging teeth 31 of the pawl 30. By this way, when the head 10 is rotated counter clockwise again, the engaging teeth 31 of the pawl 30 are quickly and smoothly engaged with the ratchet teeth 210 of the engaging portion 21 again.

Figure 10:
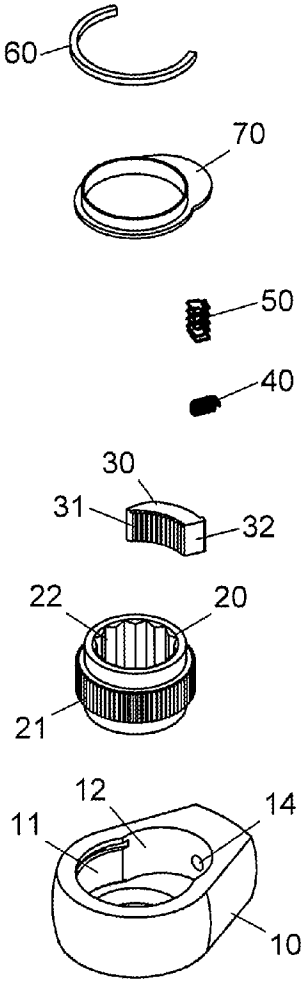
FIG. 10 is an exploded view of the second embodiment of the ratchet wrench of the present invention.

FIG. 10 shows that the second room 12 has an open top, and the ratchet wheel 21 does not have the second groove 23. A cover 70 is connected to the ratchet wheel 20 and covers the first and second rooms 11, 12. The clip 60 is mounted to the cover 70 and engaged with the first groove 15.

Figure 11:
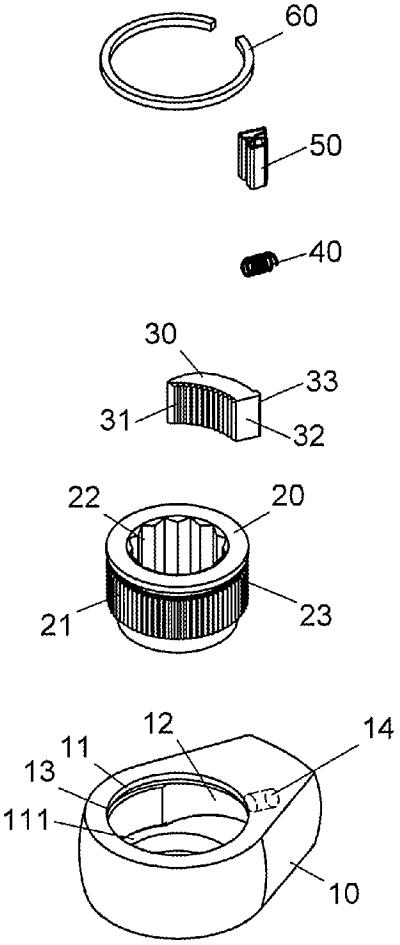
FIG. 11 is an exploded view of the third embodiment of the ratchet wrench of the present invention.
Figure 12:
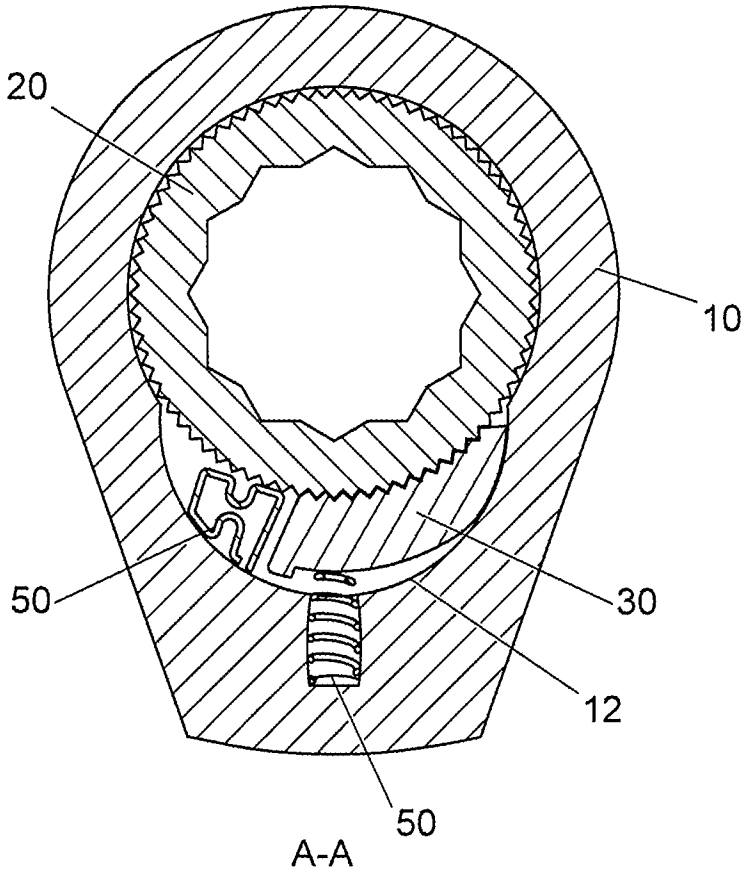
FIG. 12 is a cross sectional view of the third embodiment of the ratchet wrench of the present invention.
Figure 13:
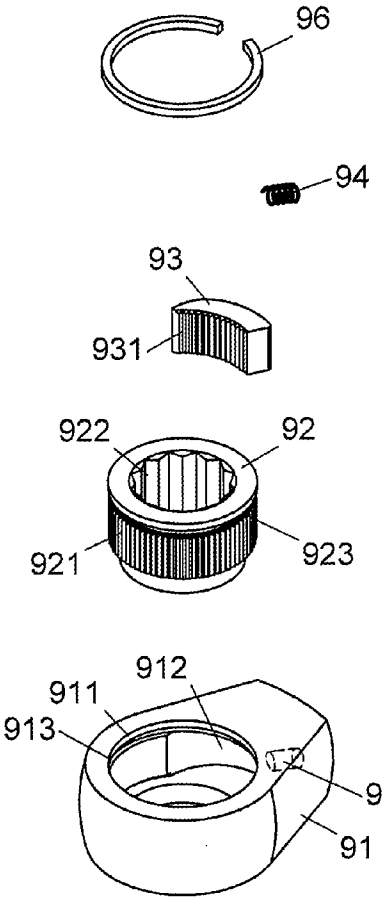
PRIOR ART FIG.13
FIG. 13 is an exploded view of a conventional ratchet wrench.
Figure 15:
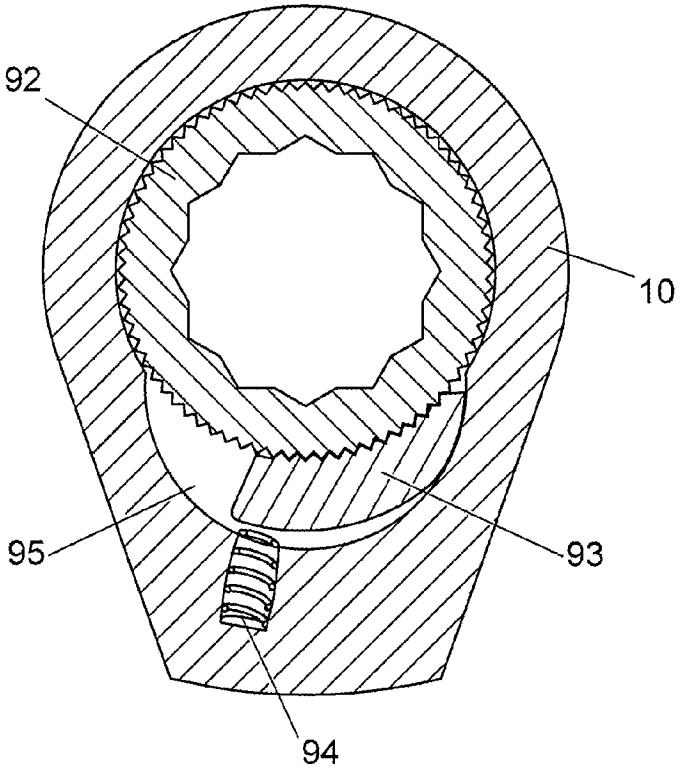
PRIOR ART FIG.15
FIG. 15 is a cross sectional view, taken along line C-C of FIG. 14.
Figure 14:
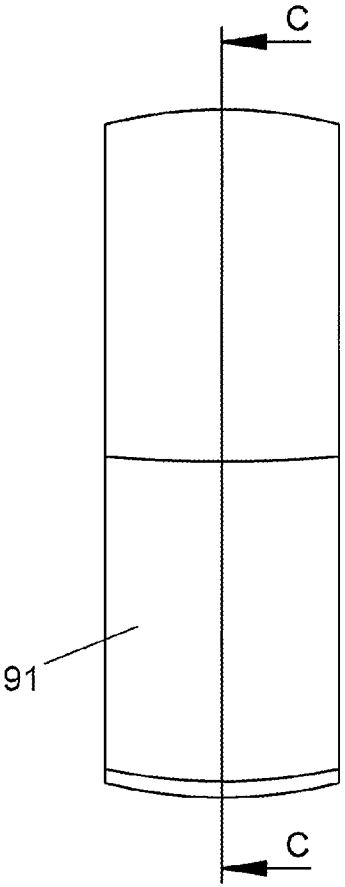
PRIOR ART FIG.14
FIG. 14 is a side view of the conventional ratchet wrench in FIG. 13.
Figure 16:
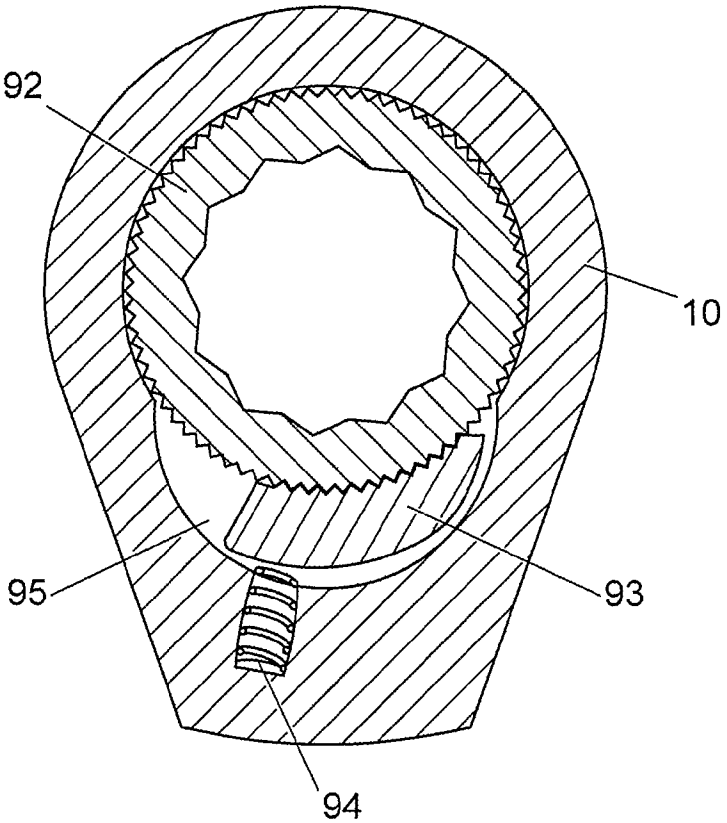
PRIOR ART FIG.16
FIG. 16 shows that the pawl of the conventional ratchet wrench is overly moved away from the pawl.

FIGS. 11 and 12 shown that the restriction member 50 is a resilient plate.

The advantages of the present invention are that the restriction member 50 in the second room 12 to restrict the movement of the pawl 30, and the volume of the pawl 30 is about ⅗ of the volume of the second room 12 so that the size of the pawl 30 is reduced to reduce the manufacturing cost.

Thanks to the angle 72 as shown in FIG. 6, when the pawl 30 is moved away from the ratchet wheel 20, the pawl 30 moves along the first contact portion 51 stably. Furthermore, the recess 14 of the present invention is easily to make.

While we have shown and described the embodiment in accordance with the present invention, it should be clear to those skilled in the art that further embodiments may be made without departing from the scope of the present invention.

What is claimed is:

1. A ratchet wrench comprising:

a head having a handle extending therefrom, the head having a first room defined through a top and a bottom thereof, a second room defined in an inner periphery of the first room, a first groove defined in the inner periphery of the first room and located close to the top of the head, a recess defined in an inner periphery of the second room;

a ratchet wheel rotatably received in the first room and having an engaging portion defined in an outer periphery thereof, the engaging portion having ratchet teeth, a mounting portion defined axially to the ratchet wheel;

a pawl received in one side of the second room and having a front side and a rear side, multiple engaging teeth defined in the front side of the pawl and engaged with the ratchet teeth of the engaging portion, the pawl having a first end and a second end, a contact face formed to the second end of the pawl, a volume of the pawl being ½ to 7/10 of a volume of the second room, a plane passing through a central axis of the first room and a central axis of the recess, an angle of 20 to 30 degrees defined between the contact face and the plane;

a resilient member received in the recess and biased between an inner end of the recess and the rear side of the pawl so as to engage the engaging teeth of the pawl with the ratchet teeth of the engaging portion;

a restriction member received in the second room and having a first contact portion, a second contact portion and a contact corner, a gap between the first contact portion and the contact face is 0 to 1 mm, the second contact portion contacting the engaging portion, the contact corner contacting an inside of the second room, and a clip engaged with the first groove to restrict the ratchet wheel in the first room.

2. The ratchet wrench as claimed in claim 1, wherein the pawl has a first curved face and a second curved face defined in the rear side thereof, the first curved face has a radius the same as a radius of the second room, the first and second curved faces are located close to the first and second ends of the pawl respectively, a protrusion extend from the second curved face.

3. The ratchet wrench as claimed in claim 1, wherein the second room has a closed top and a closed bottom.

4. The ratchet wrench as claimed in claim 1, wherein the mounting portion is a polygonal hole.

5. The ratchet wrench as claimed in claim 1, wherein the mounting portion is a polygonal rod.

6. The ratchet wrench as claimed in claim 1, wherein the volume of the pawl is ½ to ⅔ of the volume of the second room.

7. The ratchet wrench as claimed in claim 1, wherein the angle is 20 to 25 degrees.

8. The ratchet wrench as claimed in claim 1, wherein the second room has an open top, a cover is connected to the ratchet wheel and covers the first and second rooms.

9. The ratchet wrench as claimed in claim 1, wherein the restriction member is a resilient plate.

10. The ratchet wrench as claimed in claim 1, wherein the contact face is a flat face, and a lateral side of the protrusion is a flat face which is located on a same plane with the flat contact face.

* * * * *